US010415416B2

(12) United States Patent
Clark et al.

(10) Patent No.: US 10,415,416 B2
(45) Date of Patent: Sep. 17, 2019

(54) FLUID FLOW ASSEMBLY

(71) Applicant: United Technologies Corporation, Farmington, CT (US)

(72) Inventors: Thomas E. Clark, Sanford, ME (US); Brian C. McLaughlin, Kennebunk, ME (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 789 days.

(21) Appl. No.: 15/260,701

(22) Filed: Sep. 9, 2016

(65) Prior Publication Data

US 2018/0073380 A1 Mar. 15, 2018

(51) Int. Cl.

| | |
|---|---|
| ***F01D 11/12*** | (2006.01) |
| ***F01D 25/28*** | (2006.01) |
| ***F01D 11/24*** | (2006.01) |

(52) U.S. Cl.

CPC ..... *F01D 11/12* (2013.01); *F01D 11/24* (2013.01); *F01D 25/28* (2013.01); *F05D 2220/32* (2013.01); *F05D 2230/60* (2013.01)

(58) Field of Classification Search

CPC ..... F01D 11/12; F01D 11/24; F01D 11/08; F01D 25/28; F01D 25/14; F01D 25/12; F01D 19/06; F01D 19/042; F01D 19/044; F01D 9/06; F01D 9/042; F01D 9/044; F05D 2220/32; F05D 2230/60; Y02T 50/675

See application file for complete search history.

(56) References Cited

U.S. PATENT DOCUMENTS

| | | | | |
|---|---|---|---|---|
| 5,169,287 A * | 12/1992 | Proctor | F01D 5/182 415/115 |
| 5,593,277 A * | 1/1997 | Proctor | F01D 11/18 415/115 |
| 6,902,371 B2 * | 6/2005 | Anderson, Jr. | F01D 25/14 415/115 |
| 2004/0018081 A1 | 1/2004 | Anderson | |
| 2013/0192257 A1 | 8/2013 | Horine | |

FOREIGN PATENT DOCUMENTS

| | | |
|---|---|---|
| EP | 1887191 | 2/2008 |

OTHER PUBLICATIONS

European Patent Office, European Search Report dated Jan. 31, 2018 in Application No. 17188608.1006.

* cited by examiner

*Primary Examiner* — Justin D Seabe
*Assistant Examiner* — Joshua R Beebe
(74) *Attorney, Agent, or Firm* — Snell & Wilmer L.L.P.

(57) ABSTRACT

A fluid flow assembly may include an orifice plate having a set of orifices and a plenum defined by a blade outer air seal. The set of orifices may be aligned with and in fluid communication with the plenum. A gas turbine engine may include a vane outer support having an orifice plate, wherein the orifice plate includes a plurality of sets of orifices. The gas turbine engine may also include a blade outer air seal defining a plurality of plenums. Each set of orifices of the plurality of sets of orifices may be forward relative to and substantially axially aligned with a respective plenum of the plurality of plenums.

16 Claims, 4 Drawing Sheets

FLUID FLOW ASSEMBLY

FIELD

The present disclosure relates to fluid flow assemblies, and, more specifically, to orifice plates in gas turbine engines.

BACKGROUND

A gas turbine engine typically includes a fan section, a compressor section, a combustor section, and a turbine section. A fan section may drive air along a bypass flowpath while a compressor section may drive air along a core flowpath. In general, during operation, air is pressurized in the compressor section and is mixed with fuel and burned in the combustor section to generate hot combustion gases. The hot combustion gases flow through the turbine section, which extracts energy from the hot combustion gases to power the compressor section and other gas turbine engine loads. The compressor section typically includes low pressure and high pressure compressors, and the turbine section includes low pressure and high pressure turbines.

Various sections of a gas turbine include channels, compartments, or plenums through which air and/or combustion gases flow. For example, a blade outer air seal (BOAS), which is disposed radially outward from a blade/airfoil array, is generally designed to have a specific fluid pressure on a radially outward surface of the BOAS in order to maintain a desired cooling effect and, to a lesser extent, to maintain a desired radial clearance between tips of the rotating blades and a radially inward surface of the BOAS. The pressure of the air on the radially outward surface of the BOAS is conventionally controlled and supplied via an orifice in an upstream support wall of a gas turbine engine.

SUMMARY

In various embodiments, the present disclosure provides a fluid flow assembly that includes an orifice plate having a set of orifices and a plenum defined by a blade outer air seal. The set of orifices may be aligned with and in fluid communication with the plenum.

In various embodiments, the set of orifices is one set of a plurality of sets of orifices and the plenum is one plenum of a plurality of plenums. Each set of orifices of the plurality of sets of orifices may be aligned with and in fluid communication with a respective plenum of the plurality of plenums. In various embodiments, each set of orifices of the plurality of sets of orifices comprises three orifices. In various embodiments, the orifice plate and the blade outer air seal are annular, wherein the plurality of sets of orifices are distributed circumferentially relative to each other and the plurality of plenums are distributed circumferentially relative to each other.

In various embodiments, the orifice plate is mounted to a vane outer support. Each orifice in the set of orifices may have a uniform cross-sectional area, in accordance with various embodiments. A dimension of the orifice plate, in a direction parallel to the uniform cross-sectional area (and thus perpendicular to a flow direction of fluid through the orifices of the orifice plate), may be comparatively less than a diameter of a single orifice having a cross-sectional area that equals a cumulative cross-sectional area of the set of orifices. In various embodiments, the blade outer air seal includes a fluid chamber configured to be in fluid receiving communication with the plenum. In various embodiments, a first pressure of fluid upstream of the orifice plate is higher than a second pressure of fluid in the fluid chamber of the blade outer air seal, according to various embodiments.

Also disclosed herein, according to various embodiments, is a gas turbine engine that includes a vane outer support having an orifice plate, wherein the orifice plate includes a plurality of sets of orifices. The gas turbine engine also includes a blade outer air seal defining a plurality of plenums, according to various embodiments. Each set of orifices of the plurality of sets of orifices may be forward relative to and substantially axially aligned with a respective plenum of the plurality of plenums.

In various embodiments, a set of orifices of the plurality of sets of orifices includes three orifices. In various embodiments, each orifice of a set of orifices of the plurality of sets of orifices has a uniform cross-sectional area. Each orifice of a set of orifices of the plurality of sets of orifices may be radially equidistant from an engine central longitudinal axis of the gas turbine engine. A set of orifices of the plurality of sets of orifices may be circular. In various embodiments, the orifice plate extends substantially radially. In various embodiments, a radial dimension of the orifice plate is comparatively less than a diameter of a single orifice having a cross-sectional area that equals a cumulative cross-sectional area of a set of orifices of the plurality of sets of orifices.

In various embodiments, the plurality of sets of orifices is distributed circumferentially relative to each other. In various embodiments, the blade outer air seal includes a plurality of fluid chambers aft of and in fluid receiving communication with the plurality of plenums. A first pressure of fluid forward of the vane outer support may be higher than a second pressure of fluid in the plurality of fluid chambers.

Also disclosed herein, according to various embodiments, is a method of manufacturing a gas turbine engine. The method, according to various embodiments, includes forming a plurality of sets of orifices in an orifice plate of a vane outer support and aligning each set of orifices of the plurality of sets of orifices with a respective plenum defined by a blade outer air seal.

The forgoing features and elements may be combined in various combinations without exclusivity, unless expressly indicated herein otherwise. These features and elements as well as the operation of the disclosed embodiments will become more apparent in light of the following description and accompanying drawings.

Figure 1:
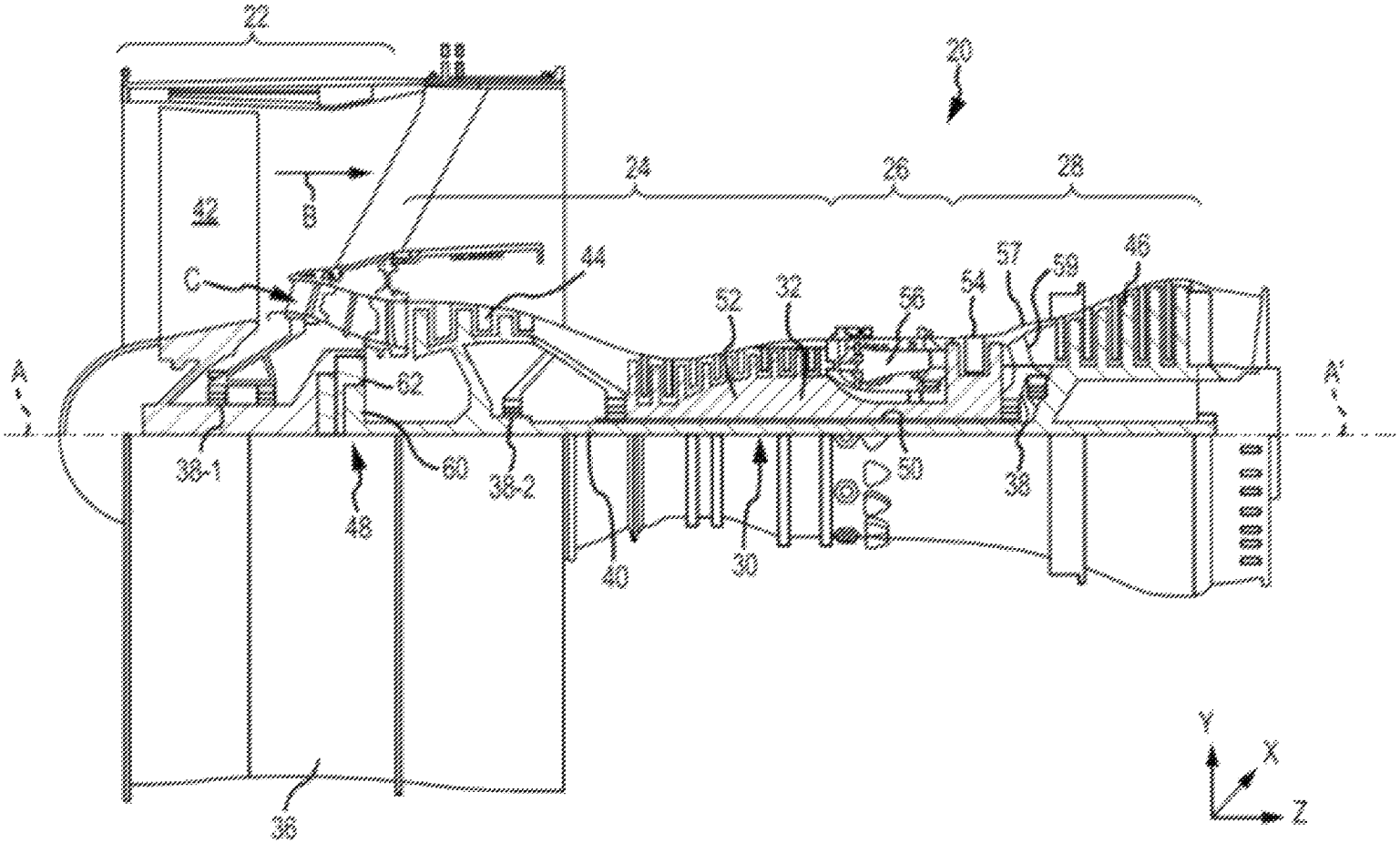
FIG. 1 illustrates a cross-sectional view of an exemplary gas turbine engine, in accordance with various embodiments.

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

DETAILED DESCRIPTION

The detailed description of exemplary embodiments herein makes reference to the accompanying drawings, which show exemplary embodiments by way of illustration. While these exemplary embodiments are described in sufficient detail to enable those skilled in the art to practice the disclosure, it should be understood that other embodiments may be realized and that logical changes and adaptations in design and construction may be made in accordance with this disclosure and the teachings herein without departing from the spirit and scope of the disclosure. Thus, the detailed description herein is presented for purposes of illustration only and not of limitation.

A first component that is "axially outward" of a second component means that a first component is positioned at a greater distance in the aft or forward direction away from the longitudinal center of the gas turbine along the longitudinal axis of the gas turbine, than the second component. A first component that is "axially inward" of a second component means that the first component is positioned closer to the longitudinal center of the gas turbine along the longitudinal axis of the gas turbine, than the second component.

A first component that is "radially outward" of a second component means that the first component is positioned at a greater distance away from the engine central longitudinal axis than the second component. A first component that is "radially inward" of a second component means that the first component is positioned closer to the engine central longitudinal axis than the second component. In the case of components that rotate circumferentially about the engine central longitudinal axis, a first component that is radially inward of a second component rotates through a circumferentially shorter path than the second component. The terminology "radially outward" and "radially inward" may also be used relative to references other than the engine central longitudinal axis. For example, a first component of a combustor that is radially inward or radially outward of a second component of a combustor is positioned relative to the central longitudinal axis of the combustor.

In various embodiments and with reference to FIG. 1, a gas turbine engine 20 is provided. Gas turbine engine 20 may be a two-spool turbofan that generally incorporates a fan section 22, a compressor section 24, a combustor section 26 and a turbine section 28. Alternative engines may include, for example, an augmentor section among other systems or features. In operation, fan section 22 can drive coolant (e.g., air) along a bypass flow-path B while compressor section 24 can drive coolant along a core flow-path C for compression and communication into combustor section 26 then expansion through turbine section 28. Although depicted as a turbofan gas turbine engine 20 herein, it should be understood that the concepts described herein are not limited to use with turbofans as the teachings may be applied to other types of turbine engines including three-spool architectures.

Gas turbine engine 20 may generally comprise a low speed spool 30 and a high speed spool 32 mounted for rotation about an engine central longitudinal axis A-A' relative to an engine static structure 36 or engine case via several bearing systems 38, 38-1, and 38-2. Engine central longitudinal axis A-A' is oriented in the z direction on the provided xyz axis. It should be understood that various bearing systems 38 at various locations may alternatively or additionally be provided, including for example, bearing system 38, bearing system 38-1, and bearing system 38-2.

Low speed spool 30 may generally comprise an inner shaft 40 that interconnects a fan 42, a low pressure compressor 44 and a low pressure turbine 46. Inner shaft 40 may be connected to fan 42 through a geared architecture 48 that can drive fan 42 at a lower speed than low speed spool 30. Geared architecture 48 may comprise a gear assembly 60 enclosed within a gear housing 62. Gear assembly 60 couples inner shaft 40 to a rotating fan structure. High speed spool 32 may comprise an outer shaft 50 that interconnects a high pressure compressor 52 and high pressure turbine 54. A combustor 56 may be located between high pressure compressor 52 and high pressure turbine 54. A mid-turbine frame 57 of engine static structure 36 may be located generally between high pressure turbine 54 and low pressure turbine 46. Mid-turbine frame 57 may support one or more bearing systems 38 in turbine section 28. Inner shaft 40 and outer shaft 50 may be concentric and rotate via bearing systems 38 about the engine central longitudinal axis A-A', which is collinear with their longitudinal axes. As used herein, a "high pressure" compressor or turbine experiences a higher pressure than a corresponding "low pressure" compressor or turbine.

The core airflow C may be compressed by low pressure compressor 44 then high pressure compressor 52, mixed and burned with fuel in combustor 56, then expanded over high pressure turbine 54 and low pressure turbine 46. Turbines 46, 54 rotationally drive the respective low speed spool 30 and high speed spool 32 in response to the expansion.

In various embodiments, geared architecture 48 may be an epicyclic gear train, such as a star gear system (sun gear in meshing engagement with a plurality of star gears supported by a carrier and in meshing engagement with a ring gear) or other gear system. Geared architecture 48 may have a gear reduction ratio of greater than about 2.3 and low pressure turbine 46 may have a pressure ratio that is greater than about five (5). In various embodiments, the bypass ratio of gas turbine engine 20 is greater than about ten (10:1). In various embodiments, the diameter of fan 42 may be significantly larger than that of the low pressure compressor 44, and the low pressure turbine 46 may have a pressure ratio that is greater than about five (5:1). Low pressure turbine 46 pressure ratio may be measured prior to inlet of low pressure turbine 46 as related to the pressure at the outlet of low pressure turbine 46 prior to an exhaust nozzle. It should be understood, however, that the above parameters are exemplary of various embodiments of a suitable geared architecture engine and that the present disclosure contemplates other gas turbine engines including direct drive turbofans. A gas turbine engine may comprise an industrial gas turbine (IGT) or a geared aircraft engine, such as a geared turbofan, or non-geared aircraft engine, such as a turbofan, or may comprise any gas turbine engine as desired.

Disclosed herein, according to various embodiments, is a fluid flow assembly. The fluid flow assembly includes, according to various embodiments, a first component that includes an orifice plate and a second component that defines a plenum. The first component, according to various embodiments, is the same as, or at least similar and analogous to, the vane outer support 110 described below and the second component is the same as, or at least similar and analogous to, the blade outer air seal 120. The orifice plate of the first component may include a set of orifices that is aligned with and configured to be in fluid communication with the plenum defined by the second component. The set of orifices of the orifice plate includes multiple orifices that are configured to feed supply fluid into the plenum.

As mentioned above, in various embodiments the plenum defined by the second component may benefit from maintaining a range of fluid pressure and the set of orifices of the orifice plate of the first component may be designed to supply fluid pressure. In various embodiments, the second component further includes a fluid chamber in fluid receiving communication with the plenum. In various embodiments, the plenum may be an inlet that is open to the fluid receiving chamber. In various embodiments, the fluid pressure in the first component may be greater than the fluid pressure in the second component. Because the orifice plate of the first component has a set (i.e., multiple) orifices aligned with each plenum, a dimension, in a direction parallel with a cross-section of the set of orifices, of the orifice plate may be comparatively less than a component that has a single orifice. That is, the set of orifices may have a cumulative area that is the same as a single orifice having a larger diameter, thus allowing the same feed supply rate of fluid into the plenum defined by the second component (due to the same cross-sectional area) but with a decreased dimension requirement of the orifice plate. Accordingly, the set of orifices decreases the dimension requirements of the orifice plate, according to various embodiments.

In various embodiments, the first component may have a plurality of sets of orifices and the second component may define a respective plurality of plenums. That is, the number of sets of orifices of the first component may correspond to and match the number of plenums defined by the second component. Additional details relating to the fluid flow assembly are included below with reference to the fluid flow assembly 105 shown in FIG. 2 and FIG. 3.

In various embodiments, the first and second components may be annular structures and the plurality of sets of orifices may be distributed circumferentially relative to each other and the plurality of plenums may be distributed circumferentially relative to each other. In various embodiments, the orifice plate is mounted/attached to the first component. In various embodiments, the orifice plate is unitary with and structurally integrated with the first component. As mentioned above, while FIG. 2 and FIG. 3 and their associated description below include details relating to a vane outer support 110 and a blade outer air seal 120 of the turbine section 28 of the gas turbine engine 20, such details may be utilized with other fluid flow systems, including, but not limited to, other sections of the gas turbine engine 20, such as the compressor section 24.

Figure 2:
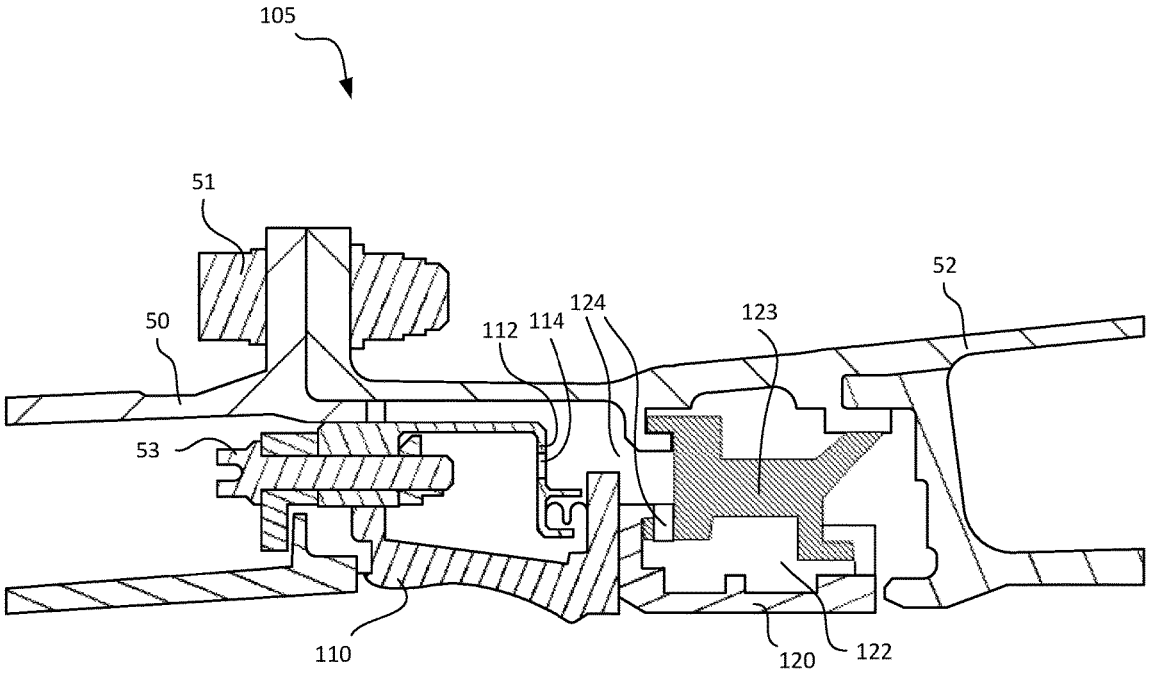
FIG. 2 illustrates a cross-sectional view of an orifice plate for feeding supply fluid to a BOAS, in accordance with various embodiments.
Figure 3:
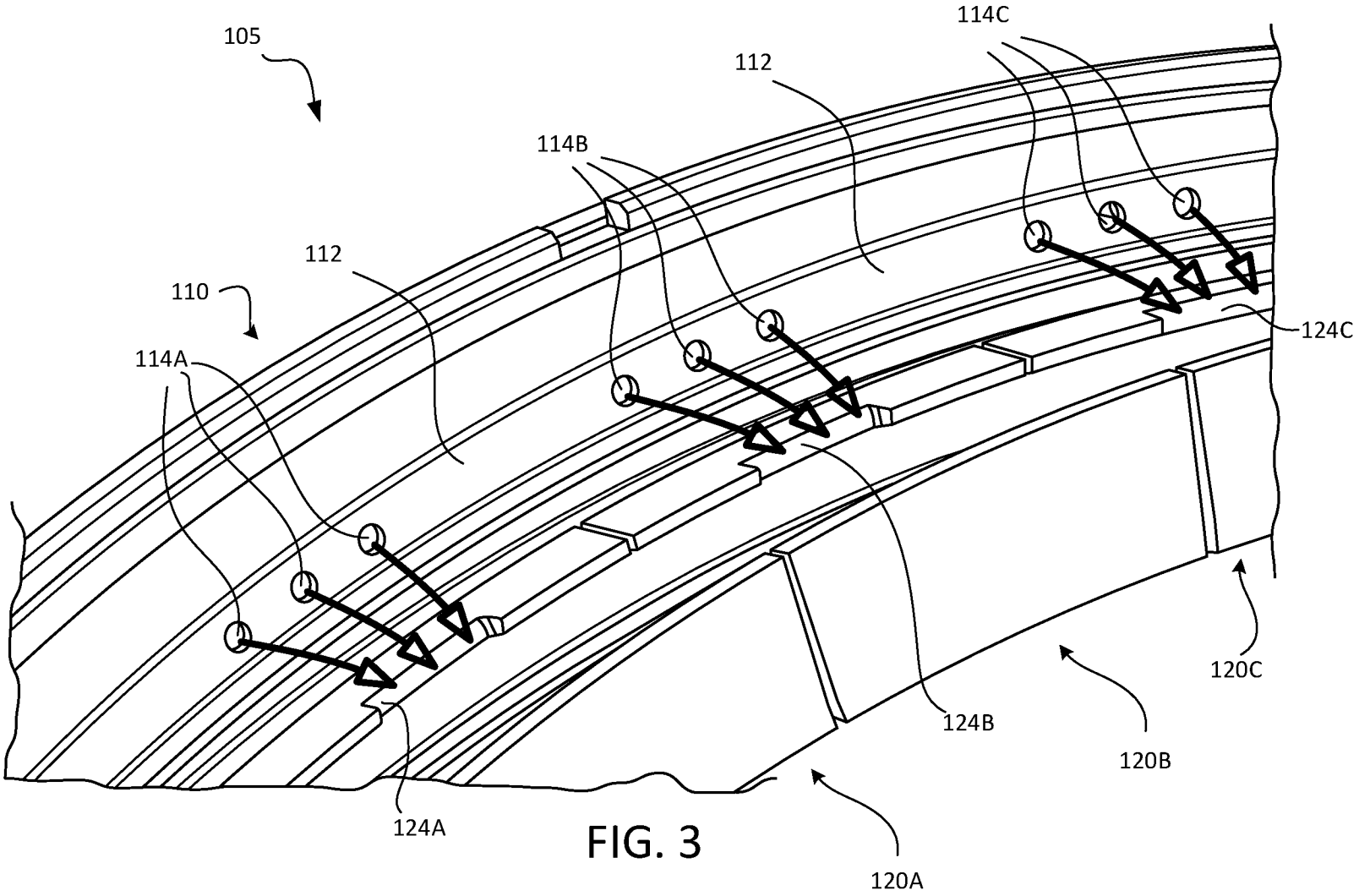
FIG. 3 illustrates a perspective view of an orifice plate feeding supply fluid to a BOAS, in accordance with various embodiments.

With reference to FIG. 2 and FIG. 3, a fluid flow assembly 105 of a gas turbine engine 20 is disclosed, in accordance with various embodiments. The fluid flow assembly 105 may include a vane outer support 110 and a blade outer air seal BOAS 120. The vane outer support is coupled to a radially outward end of the vanes and the BOAS 120 is attached to an engine case structure of the gas turbine engine 20. In various embodiments, the BOAS 120 includes and/or is coupled to the engine case structure via a BOAS support 123. In various embodiments, the vane outer support 110 includes an orifice plate 112 having a plurality of sets of orifices 114 and the BOAS 120 defines a plurality of plenums 124. In various embodiments, the BOAS support 123 at least partially defines the plurality of plenums 124. In various embodiments, each set of orifices 114A, 114B, 114C of the plurality of sets orifices 114 of the orifice plate 112 of the vane outer support 110 is aligned with and configured to be in fluid communication with a respective plenum 124A, 124B, 124C of the plurality of plenums 124 defined by the BOAS 120. For example, first set of orifices 114A of the plurality of sets of orifices 114 is aligned with and configured to direct flow into the first plenum 124A of the plurality of plenums 124, a second set of orifices 114B of the plurality of sets of orifices 114 is aligned with and configured to direct flow into the second plenum 124B of the plurality of plenums 124, and a third set of orifices 114C of the plurality of sets of orifices 114 is aligned with and configured to direct flow into the third plenum 124C of the plurality of plenums 124, according to various embodiments.

In various embodiments, the BOAS 120 may include a number of BOAS segments 120A, 120B, 120C. In various embodiments, each BOAS segment 120A, 120B, 120C may include a single respective plenum 124A, 124B, 124C of the plurality of plenums 124. However, in various embodiments each BOAS segment may define two or more plenums of the plurality of plenums 124. In various embodiments, the BOAS segments 120A, 120B, 120C are connected together circumferentially about the engine central longitudinal axis engine axis A-A' to form a shroud. According to various embodiments, the BOAS segments 120A, 120B, 120C may be formed as a unitary BOAS having the same features described herein. The vane outer support 110 may similarly be segmented or may be a unitary structure.

With reference to FIG. 1 and FIG. 2, each of the first and second compressors 44 and 52 and first and second turbines 46 and 54 in the gas turbine engine 20 comprises interspersed stages of rotor blades and stator vanes. The rotor blades rotate about the engine central longitudinal axis A-A' with the associated shaft while the stator vanes remain stationary about the engine central longitudinal axis A-A'. The first and second compressors 44, 52 in the gas turbine engine 20 may each comprise one or more compressor stages. The first and second turbines 46, 54 in the gas turbine engine 20 may each comprise one or more turbine stages. Each compressor stage and/or turbine stage may comprise multiple sets of rotating blades ("rotor blades") and stationary vanes ("stator vanes"). For example, FIG. 2 schematically shows a first turbine stage in the turbine section 28 of the gas turbine engine 20. Although many details below are in reference to turbine vanes and turbine blades, such details are also applicable to compressor vanes and compressor blades.

The BOAS 120 may include a radially inward segment/surface that faces the rotor blades. A radial tip clearance may be defined between the radially outward tip of the rotor blades and the radially inward surface of the BOAS 120. In various embodiments, the maintenance of a desired radial tip clearance is facilitated by feeding supply fluid to the plurality of plenum 124 defined by the BOAS 120 at a desired, controlled, or threshold pressure. In various embodiments, the BOAS 120 may include a plurality of fluid chambers 122 fluidly connected with the plurality of plenums 124, or at least forming part of the plurality of plenums 124. In various embodiments, a first pressure of fluid forward of the vane outer support 110 is higher than a second pressure of fluid in the plurality of plenums 124 and the plurality of fluid chambers 122.

The BOAS 120 may also include a radially outward segment/surface that faces the plenum 124. In various embodiments, the second pressure of the fluid in the plurality of plenums 124 may be higher than a fluid pressure on a radially inward side of the BOAS 120 (i.e., opposite the plenums 124). In various embodiments, the plurality of plenums 124 may be configured to have fluid that is at a comparatively lower temperature than the fluid flowing on the radially inward side of the BOAS 120. Accordingly, maintaining a higher pressure in the plenums 124, said pressure being supplied by via the orifices 114 in the orifice plate 112, provides a cooling effect, in accordance with various embodiments. In other words, heat from the fluid flowing on the radially inward side of the BOAS 120 may be transferred through the BOAS to the fluid in the plenums 124/fluid chambers 122.

In various embodiments, as shown in the FIG. 3, each set of orifices 114A, 114B, 114C may have three orifices. The number of orifices in each set of orifices and the number of sets of orifices may be dependent on a specific application. As mentioned above, the sets of orifices may be circumferentially distributed relative to each other and the plenums may be circumferentially distributed relative to each other. In various embodiments, each orifice in a set of orifices has a uniform cross-sectional shape (e.g., circular, rectangular, etc.). In various embodiments each orifice in a set of orifices has a uniform cross-sectional area. In various embodiments, each orifice in a set of orifices of the plurality of sets of orifices is radially equidistant from the engine central longitudinal axis A-A' of the gas turbine engine 20.

As mentioned above, because the orifice plate 112 of the vane outer support 110 has multiple orifices in each set of orifices, a dimension, in a direction perpendicular to a direction of flow of fluid through each set of orifices, of the orifice plate may be comparatively less than another support wall that has a single orifice. That is, each set of orifices may have a cumulative area that is the same as a single orifice having a larger diameter, thus allowing the same feed supply rate of fluid into each plenum (due to the same cross-sectional area) but with a decreased dimension requirement of the orifice plate. Accordingly, because the vane outer support 110 includes the orifice plate 112 with sets of orifices 114, the dimension requirements of the orifice plate, according to various embodiments, are decreased. In various embodiments, as shown in FIG. 2, the orifice plate 112 may extend in a radial direction. Accordingly, because of the multiple orifices in each set of orifices, the radial dimension of the orifice plate 112 is less than would otherwise be possible if a single orifice were formed in the orifice plate and aligned with the plenum. For example, the radial dimension of the orifice plate 112 may be comparatively less than a diameter of a single orifice having a cross-sectional area that equals a cumulative cross-sectional area of each set of orifices of the plurality of sets of orifices 114.

The outer vane support 110, the orifice plate 112, and/or the BOAS 120 may be made from a nickel based alloy and/or a cobalt based alloy, among others. For example, the components of the fluid flow assembly 105 may be made from a high performance nickel-based super alloy. In various embodiments, the vane outer support 110, the orifice plate 112, and the BOAS 120 of the fluid flow assembly 105 may be made from a cobalt-nickel-chromium-tungsten alloy. In various embodiments, the components 110, 112, 120 of the fluid flow assembly 105 may be made from other metals or metal alloys, such as stainless steel, etc. In various embodiments, the components 110, 112, 120 of the fluid flow assembly 105 may be resistant to corrosion and may include one or more surface coatings.

Figure 4:
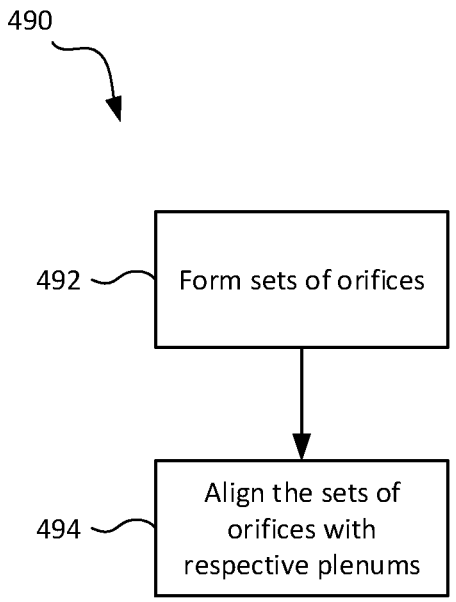
FIG. 4 illustrates a schematic flowchart diagram of a method of manufacturing a gas turbine engine, in accordance with various embodiments.

FIG. 4 is a schematic flow chart diagram of a method 490 of manufacturing a gas turbine engine, according to various embodiments. The method 490 may include forming a plurality of sets of orifices in an orifice plate of a vane outer support at step 492 and aligning each set of orifices of the plurality of sets of orifices with a respective plenum defined by a blade outer air seal at 494, in accordance with various embodiments. The method 490 may further include coupling the orifice plate (e.g., 112 in FIG. 2) to the vane outer support (e.g., 110 in FIG. 2) using a bolt 53 (FIG. 2) or other similar means, according to various embodiments. The method 490 may further include coupling the vane outer support (e.g., 110 in FIG. 2) to a combustor section (e.g., 50 in FIG. 2) or another section of the gas turbine engine using a bolt 51 (FIG. 2) or other similar means.

In various embodiments, the forming the plurality of sets of orifices in the orifice plate of the vane outer support at step 492 is performed by drilling or electrical discharge machining, among others. In various embodiments, because of the smaller dimensions of the orifices in each set of orifice when compared to the dimensions of a single orifice having a cross-sectional area equal to the cumulative cross-sectional area of the set of orifices, the accuracy and reproducibility of forming the orifices is increased, thereby improving the control and uniformity of the fluid pressure in the plenums defined by the BOAS.

As used herein, "aft" refers to the direction associated with the exhaust (e.g., the back end) of a gas turbine engine. As used herein, "forward" refers to the direction associated with the intake (e.g., the front end) of a gas turbine engine.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure.

The scope of the disclosure is accordingly to be limited by nothing other than the appended claims, in which reference to an element in the singular is not intended to mean "one and only one" unless explicitly so stated, but rather "one or more." It is to be understood that unless specifically stated otherwise, references to "a," "an," and/or "the" may include one or more than one and that reference to an item in the singular may also include the item in the plural. All ranges and ratio limits disclosed herein may be combined.

Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

The steps recited in any of the method or process descriptions may be executed in any order and are not necessarily limited to the order presented. Furthermore, any reference to singular includes plural embodiments, and any reference to more than one component or step may include a singular embodiment or step. Elements and steps in the figures are illustrated for simplicity and clarity and have not necessarily been rendered according to any particular sequence. For example, steps that may be performed concurrently or in different order are illustrated in the figures to help to improve understanding of embodiments of the present disclosure.

Any reference to attached, fixed, connected or the like may include permanent, removable, temporary, partial, full and/or any other possible attachment option. Additionally, any reference to without contact (or similar phrases) may also include reduced contact or minimal contact. Surface shading lines may be used throughout the figures to denote different parts or areas but not necessarily to denote the same or different materials. In some cases, reference coordinates may be specific to each figure.

Systems, methods and apparatus are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element is intended to invoke 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A fluid flow assembly comprising:

an orifice plate comprising a plurality of sets of orifices; and a plurality of plenums defined by a blade outer air seal;

wherein each set of orifices of the plurality of sets of orifices is aligned with and in fluid communication with a respective plenum of the plurality of plenums;

wherein a dimension of the orifice plate, in a direction parallel to a cross-section of a first set of orifices of the plurality of sets of orifices and along an axial up or downstream surface of the orifice plate, is comparatively less than a circular diameter of a single orifice having a cross-sectional area that equals a cumulative cross-sectional area of the first set of orifices.

2. The fluid flow assembly of claim 1, wherein each set of orifices of the plurality of sets of orifices comprises three orifices.

3. The fluid flow assembly of claim 1, wherein the orifice plate and the blade outer air seal are annular, wherein the plurality of sets of orifices are distributed circumferentially relative to each other and the plurality of plenums are distributed circumferentially relative to each other.

4. The fluid flow assembly of claim 1, wherein the orifice plate is mounted to a vane outer support.

5. The fluid flow assembly of claim 1, wherein each orifice in each set of orifices of the plurality of sets of orifices comprises a uniform cross-sectional area and a uniform cross-sectional shape.

6. The fluid flow assembly of claim 1, wherein the blade outer air seal comprises a fluid chamber configured to be in fluid receiving communication with the plurality of plenums.

7. A gas turbine engine comprising:

a vane outer support comprising an orifice plate, wherein the orifice plate comprises a plurality of sets of orifices; and a blade outer air seal defining a plurality of plenums;

wherein each set of orifices of the plurality of sets of orifices is forward relative to, and substantially axially aligned with, a respective plenum of the plurality of plenums;

wherein a dimension of the orifice plate, in a direction parallel to a cross-section of a first set of orifices of the plurality of sets of orifices and along an axial up or downstream surface of the orifice plate, is comparatively less than a circular diameter of a single orifice having a cross-sectional area that equals a cumulative cross-sectional area of the first set of orifices.

8. The gas turbine engine of claim 7, wherein a set of orifices of the plurality of sets of orifices comprises three orifices.

9. The gas turbine engine of claim 7, wherein each orifice of a set of orifices of the plurality of sets of orifices comprises a uniform cross-sectional area.

10. The gas turbine engine of claim 7, wherein each orifice of a set of orifices of the plurality of sets of orifices is radially equidistant from an engine central longitudinal axis of the gas turbine engine.

11. The gas turbine engine of claim 7, wherein a set of orifices of the plurality of sets of orifices is circular.

12. The gas turbine engine of claim 7, wherein the orifice plate extends substantially radially.

13. The gas turbine engine of claim 12, wherein the dimension is a radial dimension, wherein the radial dimension of the orifice plate is comparatively less than the diameter of the single orifice having the cross-sectional area that equals the cumulative cross-sectional area of the first set of orifices of the plurality of sets of orifices.

14. The gas turbine engine of claim 7, wherein the plurality of sets of orifices are distributed circumferentially relative to each other.

15. The gas turbine engine of claim 7, wherein the blade outer air seal comprises a plurality of fluid chambers aft of and in fluid receiving communication with the plurality of plenums.

16. The gas turbine engine of claim 15, wherein a first pressure of fluid forward of the vane outer support is higher than a second pressure of fluid in the plurality of fluid chambers.

* * * * *